United States Patent [19]

Rössler

[11] Patent Number: 4,520,964

[45] Date of Patent: Jun. 4, 1985

[54] WASTE COMMINUTING APPARATUS

[76] Inventor: Kurt Rössler, Blankenburgerstrasse 21a, D-4550 Bramsche 1, Fed. Rep. of Germany

[21] Appl. No.: 389,146

[22] Filed: Jun. 16, 1982

[30] Foreign Application Priority Data

Jun. 27, 1981 [DE] Fed. Rep. of Germany ..... 3125309

[51] Int. Cl.[3] ..... B02C 19/12

[52] U.S. Cl. ..... 241/55; 241/92; 241/284

[58] Field of Search ..... 241/284, 55, 56, 46.08, 241/46.11, 46.17, 69, 79.3, 92, 278 R, 296, 298

[56] References Cited

U.S. PATENT DOCUMENTS

| | | | |
|---|---|---|---|
| 2,552,933 | 5/1951 | Browne | 241/92 |
| 2,852,199 | 9/1958 | Holzer | 241/46.11 X |
| 3,014,671 | 12/1961 | Thompson | 241/296 |
| 3,480,213 | 11/1969 | Shelton, Jr. | 241/92 |

FOREIGN PATENT DOCUMENTS

| | | | |
|---|---|---|---|
| 2432603 | 1/1976 | Fed. Rep. of Germany . | |
| 2928471 | 1/1981 | Fed. Rep. of Germany . | |
| 772583 | 10/1980 | U.S.S.R. | 241/278 R |

*Primary Examiner*—Mark Rosenbaum
*Attorney, Agent, or Firm*—Jordan and Hamburg

[57] ABSTRACT

The comminuting apparatus for waste consists of a housing (1), which is circular in cross-section and defines an upright feed hopper accessible from above and which has a bottom (2) as a lower termination of the interior of the housing. Disposed in the vicinity of the bottom is a discharge opening (12) for comminuted material. In the interior of the housing there is a driven rotating substantially plate-shaped tool (6) which has an external diameter substantially corresponding to the internal diameter of the housing and is secured to a drive shaft (5) extending coaxially through the bottom (2) into the interior of the housing. The plate-shaped tool (6) is constructed in the form of a combined screening and centrifugal plate (6) which is provided with screening holes (8) only inside its closed circular peripheral edge and which sets the material in the feed hopper in circulating motion.

8 Claims, 4 Drawing Figures

WASTE COMMINUTING APPARATUS

The invention relates to a comminuting apparatus for waste.

A known apparatus of this kind (DE-OS No. 24 32 603) serves to comminute paper and has, in the lower region of the feed hopper, a screening drum which coincides with the housing wall and which is surrounded by an annular outer air passage which ends in a holding ring disposed outside the housing. Secured to this is a receiving bag for slices of paper and an air filter. The radial screening holes of the screening drum hold back paper introduced into the feed hopper in the interior of the housing until, in the course of a comminuting operation, it has been reduced in size and is suitable for passage through the screening holes.

For the comminuting of the paper, rotating comminuting tools are provided in the lower region of the feed hopper and are secured to the drive shaft extending coaxially through the bottom of the housing and the screening drum into the interior of the housing. Secured to the drive shaft at a short distance above the bottom of the feed hopper is first a radially projecting disc on which there are radially projecting blower vanes and radially projecting knives. Secured to the drive shaft at the height of the upper edge of the screening drum is a knife disc, the external diameter of which corresponds to the internal diameter of the stationary screening drum. Above this knife disc, which is provided with slits extending radially inwardly from the periphery of the knife disc, there is a second knife disc which has the same construction but a smaller diameter. Disposed above this upper knife disc there is a knife which consists of two blades located opposite one another and projecting substantially radially from the drive shaft.

If paper is introduced into the feed hopper of such a comminuting apparatus, it first meets the blade-type knife and is preliminarily comminuted, and is thereafter further comminuted by the knife slits of the disc knife. Only those slices of paper which have passed through the knife slits into the lower knife disc at the level of the upper edge of the screening drum enter the annular screening space at the level of the screening drum and there experience a further comminution by the radial knives until they finally pass, supported by a stream of air, through the screening holes of the screening drum to the outside into the air passage and through this into the receiving bag at the holding ring.

For the comminution of other waste, namely more or less lumpy objects of greater strength and size, for example wood or wood-like waste such as occurs in agricultural and forestry operation or even in horticultural operation, comminuting apparatus is used which smash such waste into small pieces with the aid of beater knives, which pieces are then supplied for further processing, for example for use as fuel. Such apparatus is sensitive, subject to considerable wear, deliver very unequally comminuted material and has only a limited capacity with considerable structural and operational expense at the same time.

For the comminution of bulky wood or other waste or bulky rubbish, high-capacity comminuting machines are also known (DE-OS No. 29 28 471), but such machines form very expensive structural units which are too expensive for the comminution of waste from forestry and agriculture, horticulture and other businesses processing wood such as carpenter's shops.

It is therefore the object of the invention to provide a structurally simple comminuting apparatus which is economical to purchase and in operation and with which wood and wood-like waste from forestry, agriculture, horticulture and small wood processing businesses can be comminuted reliably with a high performance and comparatively uniformly. In particular, branches and roots, shrubs and parts of copses, straw and smaller lumpy solid wood waste should be able to be processed by the apparatus according to the invention into small pieces of comminuted material which have an upper limit in its degree of comminution and offers a relatively high uniformity in the comminution.

The present invention is comminuting apparatus for waste, consisting of a housing of circular cross-section which defines an upright feed hopper accessible from the top and which has a bottom as a lower termination of the interior of the housing, a discharge opening disposed near the bottom for comminuted material, and a rotating, substantially plate-shaped tool in the interior of the housing, the tool having an external diameter substantially corresponding to the internal diameter of the housing and being secured to a drive shaft extending coaxially through the bottom into the interior of the housing, the plate-shaped tool being constructed as a combined screening and centrifugal plate which is provided with screening holes only inside its closed circular peripheral edge and which sets the material in the feed hopper in circulating motion.

The comminuting apparatus according to the invention, with its rotating combined screening and centrifugal plate to some extent as a lower termination of the feed hopper, embodies a comminuting principle differing from all those known. This principle consists in that the material to be comminuted in the feed hopper above the screening and centrifugal plate is set by this, in cooperation with the wall of the housing, in a constant circulating movement during which the parts to be comminuted are moved radially towards the outside above the screening and centrifugal plate, execute an upwardly directed movement along the housing wall and then return to the interior region of the feed hopper in an inwardly and then downwardly directed movement and again impinge on the screening and centrifugal plate. This movement, which is loop-shaped in cross-section, has a peripheral movement superimposed on it and this circulation, during which the objects to be comminuted constantly rub against one another and rebound against one another, leads to a comminution of the objects by interaction between these objects, until a particle size is reached which permits passage through the screening holes in the screening and centrifugal plate. As soon as sufficiently comminuted particles of material have passed down through the screening holes, they are immediately slung out through the discharge opening, possibly with support by a stream of air which develops through the feed hopper and the screening and centrifugal plate and through the discharge opening.

The combined screening and centrifugal plate accordingly serves essentially, apart from the classifying of the comminuted material, as a movement drive for the material to be comminuted which is present in the feed hopper and which then experiences its comminution in the manner described above by mutual interaction during the circulation.

An embodiment of the present invention will now be described, by way of example, with reference to the accompanying drawings, in which.

Figure 1:
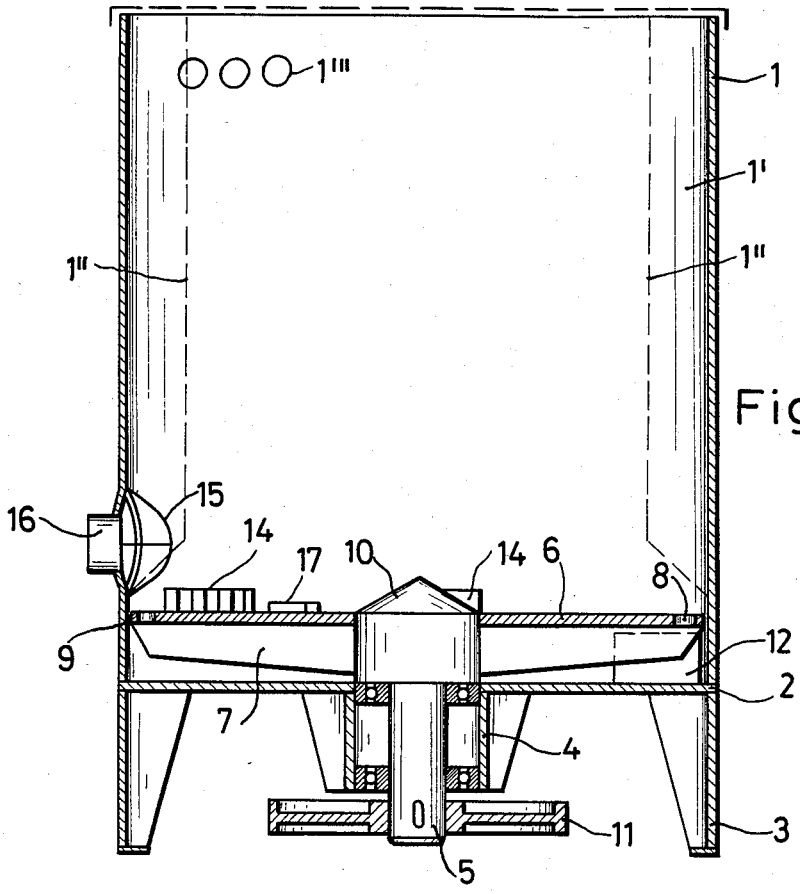
FIG. 1 shows a vertical section through a comminuting apparatus according to the invention.

As can be seen, in particular, from FIG. 1, the comminuting apparatus comprises a housing 1 which is circular in cross-section and cylindrical in the embodiment illustrated, which defines an upright feed hopper accessible from above and has a bottom 2 as a lower termination of the interior of the housing. As distinct from the cylindrical shape of the housing illustrated, the housing may also have the shape, for example, of a circular truncated cone which diverges or converges slightly upwards. Furthermore, as represented only on the right in FIG. 1 with a broken line 1″, the housing may also be provided with a tapered bulge in its lower region. This bulge forms a tapered pocket through which material to be comminuted present in the lower region of the container is pressed downwards more intensively at the outer periphery. The comminuting apparatus can be erected on any ground surface through a pedestal base 3.

At the under side of the bottom 2 of the housing 1 there is a coaxial bearing device 4 for the mounting of a drive shaft 5 which extends centrally into the interior of the housing and is provided at its lower end with a belt pulley 11 through which the drive shaft 5 receives its rotary movement from a drive motor not illustrated.

Secured to the end of the drive shaft 5 projecting into the housing is a plate-shaped tool 6 in the form of a combined screening and centrifugal plate. This screening and centrifugal plate 6 has a closed circular peripheral edge and a diameter which corresponds substantially to the diameter of the housing at the height of the screening and centrifugal plate 6, so that the peripheral edge, with the housing, delimits a marginal gap 9 sealed off from the passage of material to be comminuted. Inside the closed circular peripheral edge, the screening and centrifugal plate 6 is provided with axial screening holes 8 which are only illustrated locally in the drawing. These screening holes 8 may have a circular cross-section but instead may also have an oval shape or the like and have a diameter or a maximum dimension which corresponds to the required maximum particle size of the comminuted material.

The screening and centrifugal plate may advantageously be provided with the screening holes 8 in the region of its whole working face adjacent to the feed hopper, which holes may be disposed distributed uniformly over the working face. There is also the possibility, however, of providing a non-uniform distribution of the screening holes in the working face, for example in order to concentrate the screening holes 8 in regions in which the screening action occurs to a greater extent in the operation of the comminuting apparatus. Thus the screening holes may, for example, have such a distribution that the spacing between adjacent screening holes 8 in the working face of the screening and centrifugal plate decreases towards the peripheral edge, seen from the inside outwards, as a result of which a concentration of screening holes results in the outer region of the screening and centrifugal plate 6.

The working face of the screening and centrifugal plate 6 is substantially an annular face since, in the middle region of the screening and centrifugal plate, a guide cone 10 projecting upwards is placed on this, the significance of which will be discussed below.

In the example illustrated, the screening and centrifugal plate 6 forms a plane, circular, horizontal plate. Nevertheless, it is also possible to deviate from this particularly simple and economical shape from the structural point of view and to give the screening and centrifugal plate 6 a shape wherein the working face is slightly tapered with the apex of the cone facing upwards or downwards, is curved concavely or convexly or its stepped towards the outside in the form of annular steps.

Disposed below the screening and centrifugal plate 6 are conveyor baldes 7 which rotate as centrifugal and blower blades in the annular space between the under side of the screening and centrifugal plate 6 and the bottom 2 of the housing 1. These conveyor blades 7 are connected to the under side of the screening and centrifugal plate and form stiffening means, aligned substantially radially, for this. It is understood that in the connecting region between the screening and centrifugal plate 6 and the conveyor blades 7, the former is not provided with screening holes 8.

At the level of the gap between the under side of the screening and centrifugal plate 6 and the bottom 2 of the housing 1, there is a discharge opening 12 which is formed by the mouth of a socket 13 connected tangentially to the housing 1. A conveyor pipeline can be connected to this socket 13, for example, in which pipeline a conveyor blower is inserted. Such a conveyor blower forces a stream of air from the top downwards through the feed hopper in the housing 1, through the screening and centrifugal plate 6 and through the socket 13 to a collecting container for comminuted material, but such a stream of air is formed already simply by the screening and centrifugal plate 6 rotating with its conveyor blades 7, so that an additional conveyor blower can also be omitted. Apart from this, such a stream of air is only desirable but not absolutely essential because comminuted material is discharged even without this as a result of the centrifugal action of the conveyor blades 7 and the circulating movement of the material to be described in more detail below, even without such a stream of air. Since such a stream of air is fundamentally helpful, however, if the housing 1 is to be closable with a cover at the top, as indicated in broken lines, then the housing 1 can be provided with air inlets 1‴ in the upper region of the feed hopper. In the example illustrated, the housing 1 is provided, above the screening and centrifugal plate 6, with a bulge with which there is associated a magnet 16 for the separation of magnetic parts, such as nails or the like, which might occasionally get into the feed hopper as part of wood waste. A slightly curved inner cover 15, reaching substantially to the middle of the magnet 16 in the direction of rotation, is provided over this bulge.

At its upper side, the screening and centrifugal plate 6 is provided in the region of its peripheral edge with at least one entrainment dog 17. Preferably, however, the screening and centrifugal plate 6 carries two entrainment dogs 17 disposed diametrically. The entrainment dog or dogs may comprise a radial front 18 or a front set obliquely inwards and backwards in the direction of rotation as illustrated, which may also be equipped with a cutting edge. A blunt front on the flat entrainment dog 17 is sufficient, however, because this mainly has the purpose of reinforcing the conveying movement of the material to be comminuted and to cause impact effects.

In cases in which the material to be comminuted consists of pieces with comparatively long stems, as is the case, for example, with bushes and some woods, or has a low density as is the case with straw for example, one or more flat knives 14, 19 can be placed eccentrically on the upper side of the screening and centrifugal plate 6. These flat knives can be dispensed with in the case of numerous materials to be comminuted but even with these have an effect which aids performance. For reasons of balance, such flat knives 14, 19 are preferably used in pairs, being arranged diametrically opposite in each case.

Figure 2:
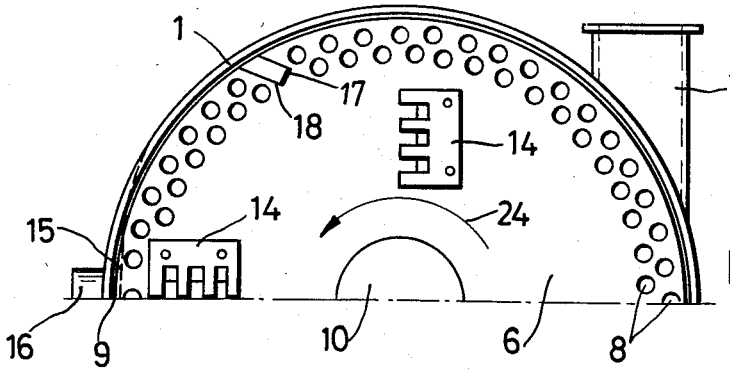
FIG. 2 shows a half plan view of FIG. 1.
Figure 3:
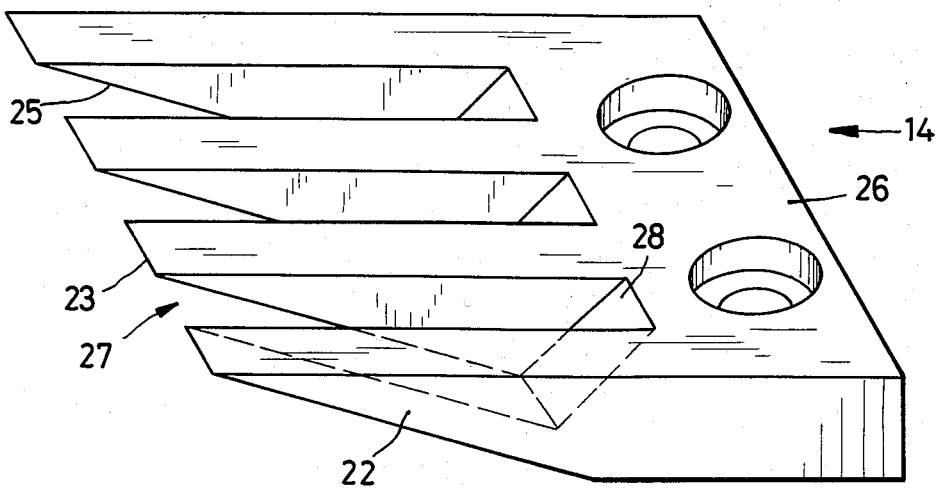
FIG. 3 shows a perspective illustration of a flat knife of piercing finger construction.

In the embodiment shown in FIGS. 2 and 3, the flat knives 14 are constructed in the form of piercing finger knives. The piercing fingers 22 of such flat knives 14 have, at their front end in the direction of rotation 24 of the screening and centrifugal plate 6, cutting edges 23 which are spaced above the working face of the screening and centrifugal plate and which are followed, at the under side, by an indrawn chip throat 25. The piercing fingers 22, which are accordingly wedge-shaped in side view, extend in the form of a comb from a closed knife back 26 remote from the direction of rotation 24 and define between them free spaces 27 which reach down to the working face of the screening and centrifugal plate and are bounded in the region of the knife back 26 by a terminal face 28 which rises upwards in wedge-shape. The width of the free spaces 27 between the piercing fingers 22 preferably corresponds at least substantially to the maximum dimension of the screening holes.

Figure 4:
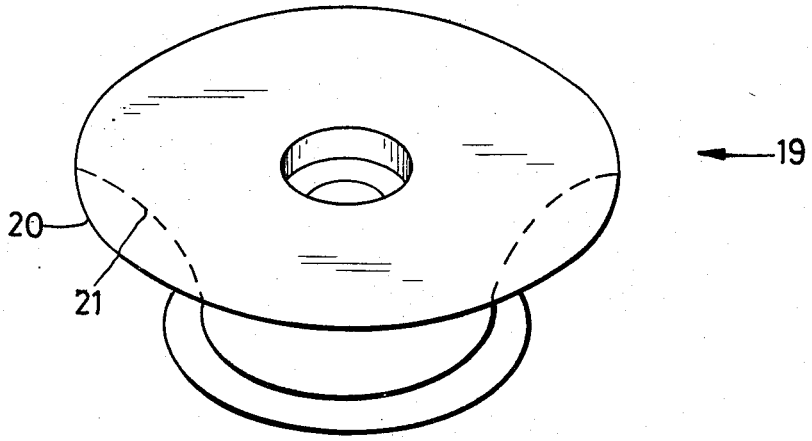
FIG. 4 shows a perspective illustration of a flat knife of circular disc construction.

Instead of such a construction in which the flat knives 14 exert a cutting and breaking function, the flat knives 19 may also be constructed in the form of a flat circular disc, as shown in FIG. 4, which has a circular cutting edge 20 extending with spacing above the working face of the screening and centrifugal plate 6 and comprises a chip throat 21 drawn inwards in a taper or curved inwards and extending round between the cutting edge and the working face.

For the operation of the comminuting apparatus, material to be comminuted of the kind determined is introduced into the feed hopper of the housing 1, for example up to $\frac{2}{3}$ of the height of the feed hopper. If the screening and centrifugal plate 6 is now set in rotation, all the material to be comminuted gradually becomes involved in the circulating movement described at the beginning, as a result of the centrifugal action of the screening and centrifugal plate on the material coming into contact therewith. In the central region of the feed hopper, a hollow funnel forms in the circulated mass of material and the guide cone 10 ensures that no accumulation of material can form in the central region of the screening and centrifugal plate 6 which might escape the circulating movement. As a result of this circulating movement, the material to be comminuted comminutes itself by mutual rubbing, beating and striking, the required comminuting forces being reinforced by the impingement action of the entrainment dogs 17. The flat knives in turn contribute to a preliminary comminution in the case of the material to be comminuted which is difficult to process and which has already been mentioned, so that such material is also included in the rotational circuit. Small comminuted pieces or particles formed during the circulation self-comminution, the dimensions of which are less than the dimensions of the screening holes 8, fall through the screening holes 8 or are forced through these as soon as they impinge on the screening and centrifugal plate 6 or slide over this in the course of the circulatory movements. The screening holes 8 can be selected freely in their shape and dimensions in view of the degree of comminution required, may be formed by cylindrical bores or bores widening upwards in a slight taper and have, at their transition into the working face of the screening and centrifugal plate, edges which in turn have an aggressive effect on the material to be comminuted in the feed hopper, in the sense of comminuting and conveying. The particles of material passing downwards through the screening holes 8 are immediately caught by the conveyor blades 7 and slung out through the discharge opening 12, and their discharge may be reinforced by the stream of air mentioned above.

The obtuse-angled guide cone 10 not only prevents accumulations of material in the central region but also a flat lying of plate-shaped pieces, etc., so that even such objects come back into the range of action of the flat knives 14 or 19 by tipping over and experience a progressive preliminary comminution. The obtuse-angled cone construction also prevents objects from jamming between the guide cone 10 and the wall of the housing 1. If a damming effect occurs, objects can also be held back or pressed back from the outside inwards and are then conveyed upwards by the outer face of the guide cone and re-introduced into the movement of material.

The piercing-finger knife 14 knocks precisely limited pieces out of larger objects and is therefore particularly suitable for nearly all material to be comminuted which can be broken or cut, particularly as the free spaces encourage breaking actions on chip-like objects which may come to lie in the chip throats 25 under the piercing fingers 22. The flat knives 19 of circular shape on the other hand present a comparatively longer cutting edge and have a stronger cutting action on certain lumpy articles to be comminuted and because of their round shape have a satisfactory penetrating action on passing through the circulated stream of material.

The stream of air, already mentioned above and developing through the feed hopper and the screening and centrifugal plate 6 not only reinforces the discharge of particles of material which have been sufficiently comminuted through the socket 13 but also has a cooling action and in particular causes a reinforced screening because the downwardly directed component of movement on the material being comminuted, particularly particles of material contained in this and already sufficiently comminuted is reinforced. Also the total pressure of the mass of material being circulated is reinforced on the screening and centrifugal plate 6.

Instead of a unitary construction of the screening and centrifugal plate 6, this may also be composed of circular segments which are placed on the conveyor blades 7 as a supporting framework and are individually connected to the conveyor blades 7 so that, if necessary, partial replacements are possible in the course of maintenance work. In order to increase the throughput capacity, two or more screening and centrifugal plates may also be disposed coaxially with spacing one above the other. In such a case with a plurality of screening and centrifugal plates disposed one above the other, the dimensions of the screening holes may decrease from the uppermost towards the lowest screening and centrifugal plate.

I claim:

1. Comminuting apparatus for the comminution of waste wood material and the like by imparting a loop shaped circulating movement to the waste so that the waste comminutes itself by mutual rubbing, beating and striking, comprising a housing having an inner wall of a generally circular cross-sectional configuration, said housing having a top with an access opening for receiving the waste to be comminuted, said housing defining a feed hopper for the waste to be comminuted, said housing having a bottom portion disposed above a bottom wall, a combined screening and centrifugal plate rotatably mounted in the bottom portion of said housing, said plate having an upper side and an under side, a raised entrainment dog extending upwardly from said upper side at the peripheral edge of said plate, centrifugal blower blades mounted on the underside of said plate, said blades being disposed in said bottom portion of said housing between said plate and said bottom wall of said housing, said centrifugal blower blades being substantially radially disposed and forming stiffening means for said plate, said bottom portion of said housing having an outlet for comminuted material, said outlet being disposed below said plate, said plate having a continuous circular outer edge having a diameter substantially equal to the inner diameter of said housing such that comminuted material is precluded from passing between said outer edge of said plate and the inner wall of said housing, drive shaft means attached to said plate for rotating said plate, said drive shaft means extending externally of said housing, said plate having an outer radial portion disposed inwardly of said outer edge, a plurality of screening holes in said plate at said outer radial portion for screening and passing the comminuted material from said housing to said outlet, an upwardly projecting guide cone extending upwardly from the central region of said plate, said guide cone having a continuous conical surface having its apex upwardly disposed, said plate and said housing being constructed and arranged to impart a loop-shaped circulating movement to the waste in said housing as a result of the centrifugal action of said plate on the waste coming into contact with said plate such that the waste moves radially outwardly at the bottom portion of said housing above said plate, generally upwardly at the radial outer portion of said housing, generally radially inwardly at the upper portion of said housing and generally downwardly at the radial inner portion of said housing as a hollow funnel forms in the circulated mass of waste material and the waste once again repeats the loop-shaped circulatory movement as the comminuted pieces and particles formed during said loop-shaped circulatory movement of less than the diameter of said screening holes passes out of said housing through said screening holes in said plate, said waste to be comminuted thereby comminuting itself by mutual rubbing, beating and striking as said waste travels said loop-shaped circulatory movement.

2. Comminuting apparatus according to claim 1, wherein said entrainment dog has a cutting edge.

3. Comminuting apparatus according to claim 1 in which said plate is also provided with spaced screening holes over a radial inner portion of said plate.

4. Comminuting apparatus according to claim 3 in which the spacing between the screening holes is greater at said inner radial portion than at said outer radial portion.

5. Comminuting apparatus according to claim 1, in which at least one flat knife is placed eccentrically on the upper side of said plate.

6. Comminuting apparatus according to claim 5, in which said flat knife comprises a flat circular disc having a circular cutting edge spaced above the upper side of said plate, and an encircling chip throat between said circular cutting edge and said upper side of said plate.

7. Comminuting apparatus according to claim 5, in which said flat knife comprises piercing finger knives having cutting edges extending at their front edge in the direction of rotation of said plate, said finger knives being spaced above the upper side of said plate to provide an in drawn chip throat between said cutting edges and said upper side of said plate.

8. Comminuting apparatus according to claim 7, in which said piercing finger knives project comb-like from a closed knife back remote from the direction of rotation of said plate and define between them free spaces which extend down to said upper side of said plate and are bounded in the region of said closed knife back by a terminal wedge-shaped rising surface.

* * * * *